US011833380B2

(12) United States Patent
Brooker

(10) Patent No.: US 11,833,380 B2
(45) Date of Patent: Dec. 5, 2023

(54) FLAME ARRESTER/BURNER ASSEMBLY WITH A MULTIFARIOUS ELEMENT FOR PREVENTING DEFLAGRATIONS AND EXTENDED ENDURANCE BURNING TIME

(71) Applicant: Dwight Brooker, Chiefland, FL (US)

(72) Inventor: Dwight Brooker, Chiefland, FL (US)

( * ) Notice: Subject to any disclaimer, the term of this patent is extended or adjusted under 35 U.S.C. 154(b) by 465 days.

(21) Appl. No.: 16/794,201

(22) Filed: Feb. 18, 2020

(65) Prior Publication Data

US 2020/0376309 A1 Dec. 3, 2020

Related U.S. Application Data

(60) Provisional application No. 62/806,527, filed on Feb. 15, 2019.

(51) Int. Cl.

| | |
|---|---|
| ***A62C 4/04*** | (2006.01) |
| ***F23D 99/00*** | (2010.01) |
| *F23G 7/08* | (2006.01) |

(52) U.S. Cl.
CPC ..... *A62C 4/04* (2013.01); *F23D 91/00* (2015.07); *F23G 7/085* (2013.01)

(58) Field of Classification Search
CPC .. A62C 4/02; A62C 4/04; F23D 91/00; F23G 7/085
See application file for complete search history.

(56) References Cited

U.S. PATENT DOCUMENTS

| | | | | | |
|---|---|---|---|---|---|
| 1,701,805 | A * | 2/1929 | James | A62C 4/02 | 138/40 |
| 2,391,592 | A * | 12/1945 | Pierson | A62C 4/02 | 48/192 |
| 3,148,962 | A * | 9/1964 | Dellinger | A62C 4/02 | 48/192 |
| 4,975,098 | A * | 12/1990 | Lee | A62C 4/02 | 48/192 |
| 5,145,360 | A * | 9/1992 | Rajewski | F23G 5/50 | 222/189.01 |
| 5,415,233 | A * | 5/1995 | Roussakis | B01J 19/002 | 169/48 |
| 2002/0129947 | A1* | 9/2002 | Leinemann | A62C 4/02 | 169/48 |
| 2010/0218958 | A1* | 9/2010 | Cooling | A62C 4/02 | 169/45 |
| 2010/0311001 | A1* | 12/2010 | Helmsen | B01J 19/002 | 431/350 |

* cited by examiner

*Primary Examiner* — Justin M Jonaitis
(74) *Attorney, Agent, or Firm* — Scott R. Zingerman; GableGotwals

(57) ABSTRACT

A flame arrester/burner assembly with a multifarious arrester element for preventing deflagrations and extended endurance burning time (FABA-XT). The multifarious element flame arrester includes a pipe body having a first end and a second end, a first arrester element positioned within the pipe body adjacent the top end; a third arrester element adjacent the bottom end; and, a second arrester element positioned in the pipe body between the first arrester element and the second arrester element. The first, second, and/or third arrester elements may be of the same design or disparate designs. The FABA-XT of the present disclosure is an end-of-line burner element for use in VOC-Vapor Destruction Systems.

2 Claims, 6 Drawing Sheets

FLAME ARRESTER/BURNER ASSEMBLY WITH A MULTIFARIOUS ELEMENT FOR PREVENTING DEFLAGRATIONS AND EXTENDED ENDURANCE BURNING TIME

CROSS REFERENCE TO RELATED APPLICATION

This application claims the benefit of U.S. Provisional Application No. 62/806,527 filed Feb. 15, 2019, and incorporates such provisional application by reference into this disclosure as if fully set out at this point.

FIELD OF THE INVENTION

The present invention relates to the field of flame arresters, generally, and combined flame arrester and burner assemblies more particularly.

BACKGROUND OF THE INVENTION

The vapor destruction systems currently in use employ an open flame to burn volatile organic compound (VOC) vapors and any enrichment gas routed to it. In most installations, the flame is contained inside a large refractory lined cylindrical stack with the burner mounted near the base of the stack, an enclosed design. In other applications the burner is mounted at the top of an elevated riser and not contained in a stack, a visible flame design.

At this time, the major manufacturers of VOC-Vapor Destruction Systems use these types of burner technologies. Depending on the capacity of the vapor control system, from one to ten burners are used for these combustion systems. Typically, air is forced directly around the perimeter of each burner to keep it cool. Additionally, this air provides turbulence to the waste gas stream to maintain smokeless combustion, which is required by air pollution regulatory authorities.

Test Procedures for Current Configurations of Flame Arrester Burners

Currently, there are no United States Coast Guard (USCG) test procedures approved that establish a design for flame arrester burners used in vapor destruction devices. However, exemptions for the elimination of the Liquid Seal required by 33 C.F.R. § 154.828(b) have been granted IF a flame arrestor burner is utilized. This approval has been granted, on a case-by-case basis, and as such the typical flame arrestor burner designs have a proven track record. These burners along with USCG approved (Appendix A) detonation arresters and temperature sensing devices have been approved at many locations. Title 33 C.F.R. § 154.828 (b) does allow the use of USCG approved inline flame arrestors, but it is believed that there are no USCG approved inline flame arrestors currently known in the art. Appendix A and 33 C.F.R. § 154.828(b) are incorporated fully herein by reference.

SUMMARY OF THE INVENTION

The Flame Arrester/Burner Assembly with a Multifarious Element for Preventing Deflagrations and Extended Endurance Burning Time (FABA-XT) of the present disclosure is designed as an end-of-line burner element for use in VOC-Vapor Destruction Systems. The FABA-XT can be used in either an enclosed design or a visible flame design.

Proposed Service of the FABA-XT

The intended service of the FABA-XT is as a replacement for three (3) components currently used on Vapor Destruction Units. A large, flame arrester installed in close proximity to the combustion unit (approximately ten to twelve inches from the burner tip).

One embodiment of a multifarious flame arrester of the present invention includes: a pipe body having a top end and a bottom end; a first arrester element positioned within said body adjacent said top end; a third arrester element positioned within said body adjacent said bottom end; and, a second arrester element positioned within said body between said first arrester element and said third arrester element.

The first, second, and/or third arrester elements may be of the same design or disparate designs. In one preferred embodiment, the first, second, and third arrester elements are disparate designs and in another preferred embodiment the first, second, and/or third arrester elements are of the same design. It is understood that the first and second, second and third, or first and third arrester elements may be the same of different, and may be the same or different than the other.

In one preferred embodiment, the first, second, and third arrester elements may be disparate. This embodiment may include a first single element (crimped ribbon) flame arrester segment, a second, ceramic element; and, a third arrester element including a basket shaped element or two such elements joined to make an hourglass design around which media may be placed.

In another preferred embodiment, the first, second and third arrester elements are of the same design, such as a crimp ribbon construction. These arrester elements are secured within the pipe body.

Temperature sensing element(s) may be mounted near any or all of the arrester elements or in any other desired location to monitor the flame temperature It is contemplated that the use of the FABA-XT incorporating a temperature sensing device between the elements performs better than the prior art configurations discussed above. This is because there is no run-up distance between the first flame arresting element and the second deflagration arrester element since they are so closely coupled. The compact design eliminates the potential for a high-speed deflagration or sonic/supersonic detonation. The "Extended Endurance Burning Time" of the FABA-XT corrects a critical deficiency present in a Single element (crimped ribbon) flame arrester burner tip and adds an unmeasurable performance margin to the installations that these phenomena occur in.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Burner/Arrester Description

Figure 1:
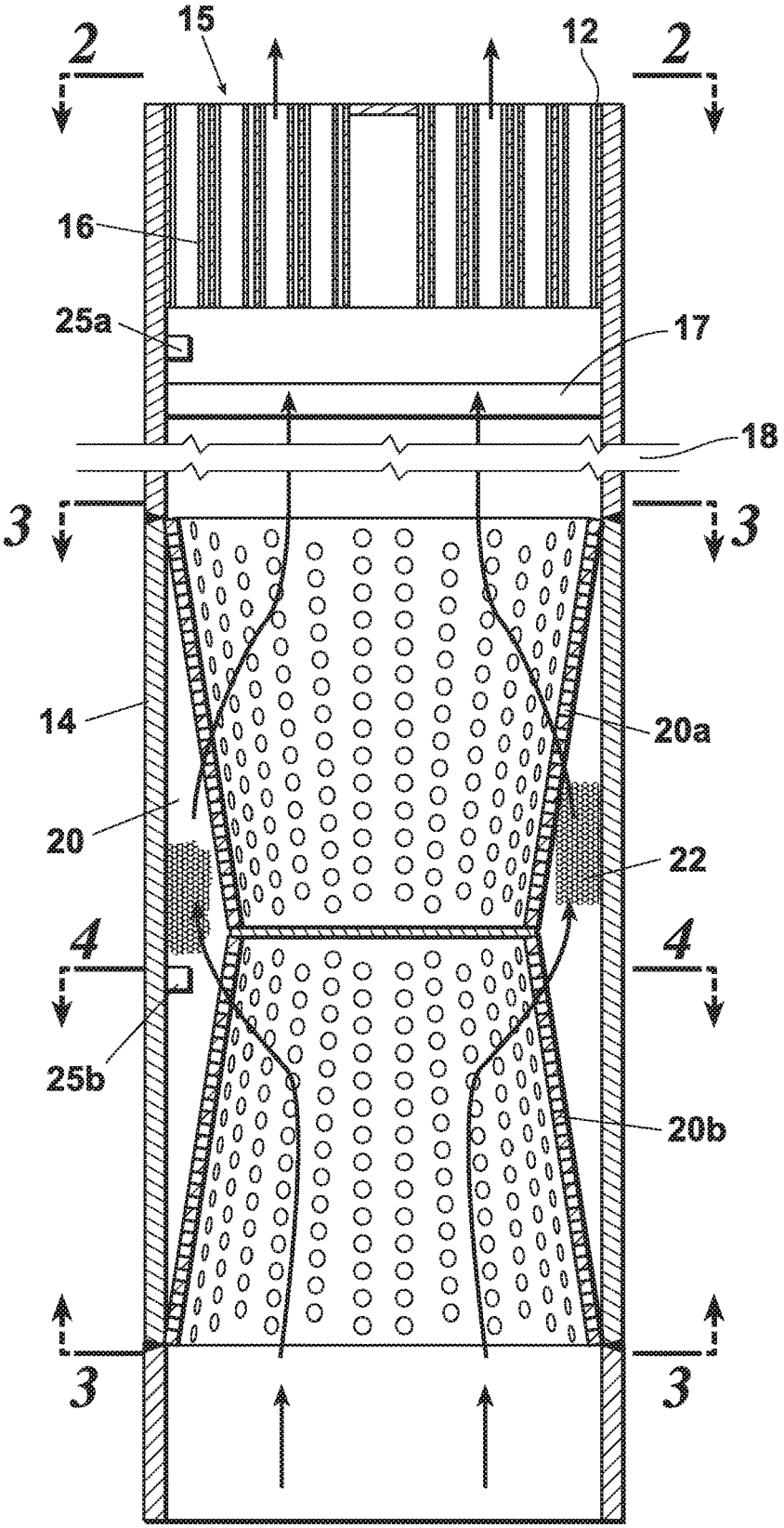
FIG. 1 is a side vertical cut-away view of the flame arrester/burner assembly of the present invention.

The FABA-XT of the present disclosure includes up to 4 separate flame/deflagration suppression matrices closely coupled within a single burner. The four matrices are preferably combined into two separate elements 15 (element 15 includes matrices 16 and 17) and 20 (element 20 includes matrices 20*a*, 20*b*, and 22 which combined make one single element 20) or four individual matrices 16, 17, 20*a*, 20*b* and 22, working together or separately depending on the application & extended burn time required. These four matrices make-up the arrester/burner design 10 of the present disclosure in a preferred embodiment of FIG. 1.

Figure 2:
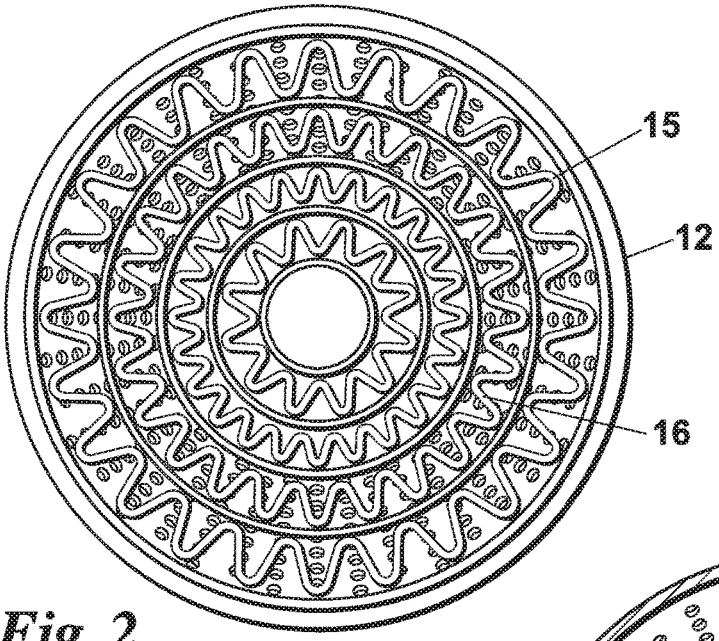
FIG. 2 is a view taken along line 2-2 of FIG. 1.

The first matrix is the visible element 16 at the burner tip 12. Its configuration is of preferably a crimped ribbon design known for use in "anti-flashback" or "anti-burn-back" burner elements. The concentric crimped ribbon matrix 16 can be seen in FIG. 1 taken in combination with FIG. 2.

The second matrix 17 may be either a second (third, or more) crimp ribbon element(s) (same as matrix 16 of FIG. 2) or, in a most preferred embodiment, a porous ceramic disk (or similar low thermal conductive materials) or a combination of crimp ribbon and ceramic disk matrices. The second matrix 17 is the first line of defense against an extended burn. For this purpose a porous low thermally conductive material such as a porous ceramic disk (FIG. 5) is particularly suited. Representative examples of this matrix can be seen in FIG. 5. This second matrix 17 can be left out of the design in a more basic embodiment if the extended burn time for that application isn't required and replaced with a second (or more) crimped ribbon section (such as 16 of FIG. 2) or left out altogether if pressure is a higher priority than the added burn time performance.

Figure 3:
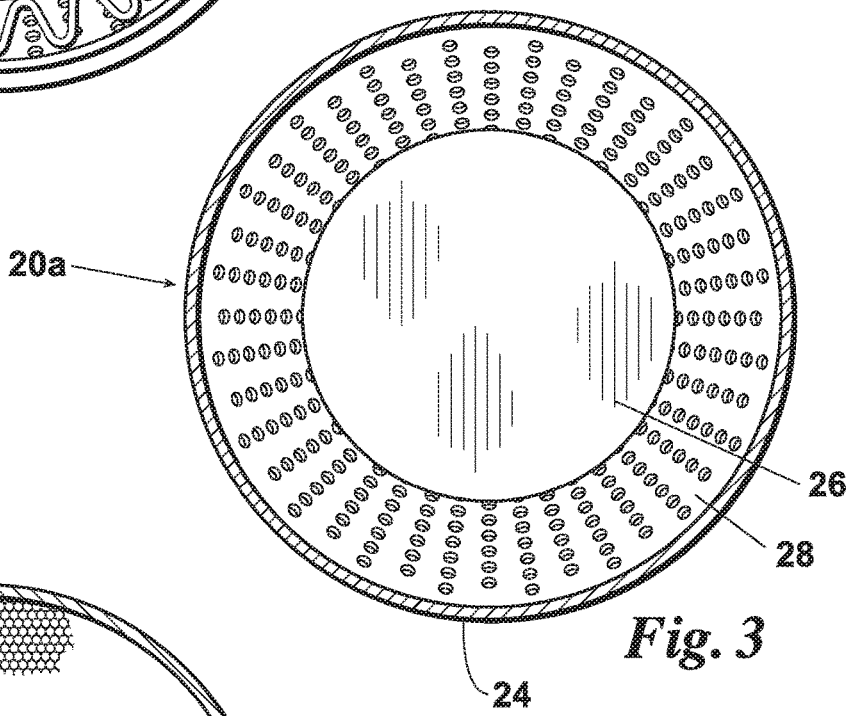
FIG. 3 is a view taken along line 3-3 of FIG. 1.
Figure 4:
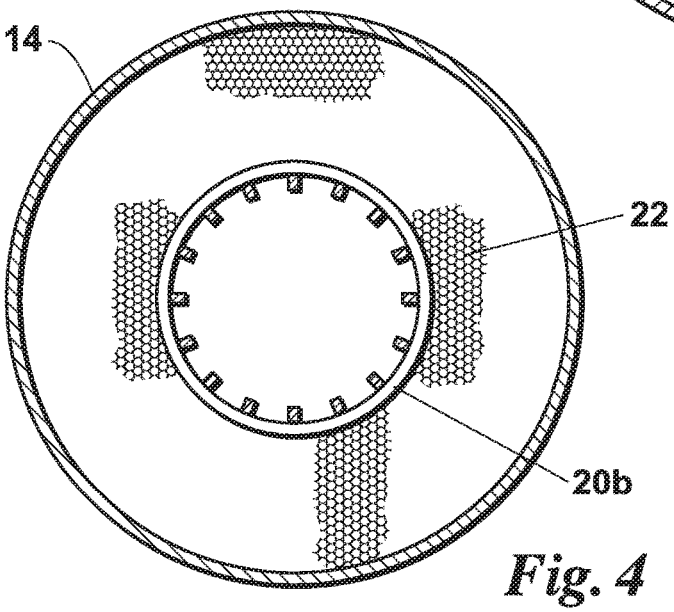
FIG. 4 is a view taken along line 4-4 of FIG. 1.

The third matrix is formed by the combination of basket shaped matrices 20*a* and 20*b*. Basket shaped matrices 20*a* and 20*b* are preferably screen covered perforated baskets with maximum free flow area (100% preferred). With reference to FIG. 3 taken in combination with FIG. 1, basket shaped matrix 20*a* includes an open top 24 and a closed bottom 26. Basket shaped matrix 20*a* includes a substantially frustoconical geometry in a preferred embodiment with a perforated circumference 28 to allow passage of VOC vapors. The screen allows the passage of gas but prevents the passage of media 22 (discussed below) from passing therethrough and into basked 20*a*.

Basket shaped matrix 20*b* is preferably constructed substantially the same as basket shaped media 20*a* but inverted within housing 14. Basket shaped matrices 20*a* and 20*b* can alternatively be made from screen covered wedge-wire forming baskets may be formed as a single unit.

The fourth matrix is preferably comprised of a porous medium 22 formed by roundish shaped filler media that can be made from either cut wire metal shot or in this preferred embodiment ceramics shot or beads. Medium 22 is porous so as to allow the passage of gas (VOC vapors) to pass therethrough as shown by the flow path arrows depicted in FIG. 1.

Basket shaped matrices 20*a*, 20*b* and porous media 22 which combine to form third element 20 are located within the burner housing 14 and are within close proximity (within 14", 12", 10", 8" or as any size in between as shown at 18) to the first and second matrices 16 and 17. Basket shaped matrices 20*a* and 20*b* when combined with cut wire shot in porous media 22 have been shown to prevent the passage of high pressure fronts.

As stated, third matrices 20*a* and 20*b* and fourth matrix 22 combined form a single element of the arrester/burner 10 of the present disclosure. Matrices 20*a*, 20*b* and 22 are fabricated of materials that are more substantial than the crimped ribbon matrix 16 and are designed to withstand a flame front traveling from the combustion zone at or near burner tip 12 through element 15 in the event of its failure. Because the distance between matrices 16 and 17, as well as element 20 is so short (18) there is an inadequate length of piping to have run-up distance that could generate a high deflagration pressure front(s) if the matrix 16 and/or 17 fails. Porous medium 22 can be configured to utilize either metal filler for higher pressure deflagration fronts or material like ceramics or similar low thermal conductive material that will extend the burn time, while at the same time preventing the propagation of a deflagration.

In one preferred embodiment, a temperature-sensing device 25*a* is mounted between the two matrices 16 and 17 and/or within 25*b* element 20 (within enclosure 14) to indicate a failure of the first element 15 and possibly second element 20.

Maintaining a known waste gas exit arrangement is preferable because there is a large amount of operational history and practical knowledge on the destruction efficiency and combustion characteristics of that design with the manufacturers.

Figure 5:
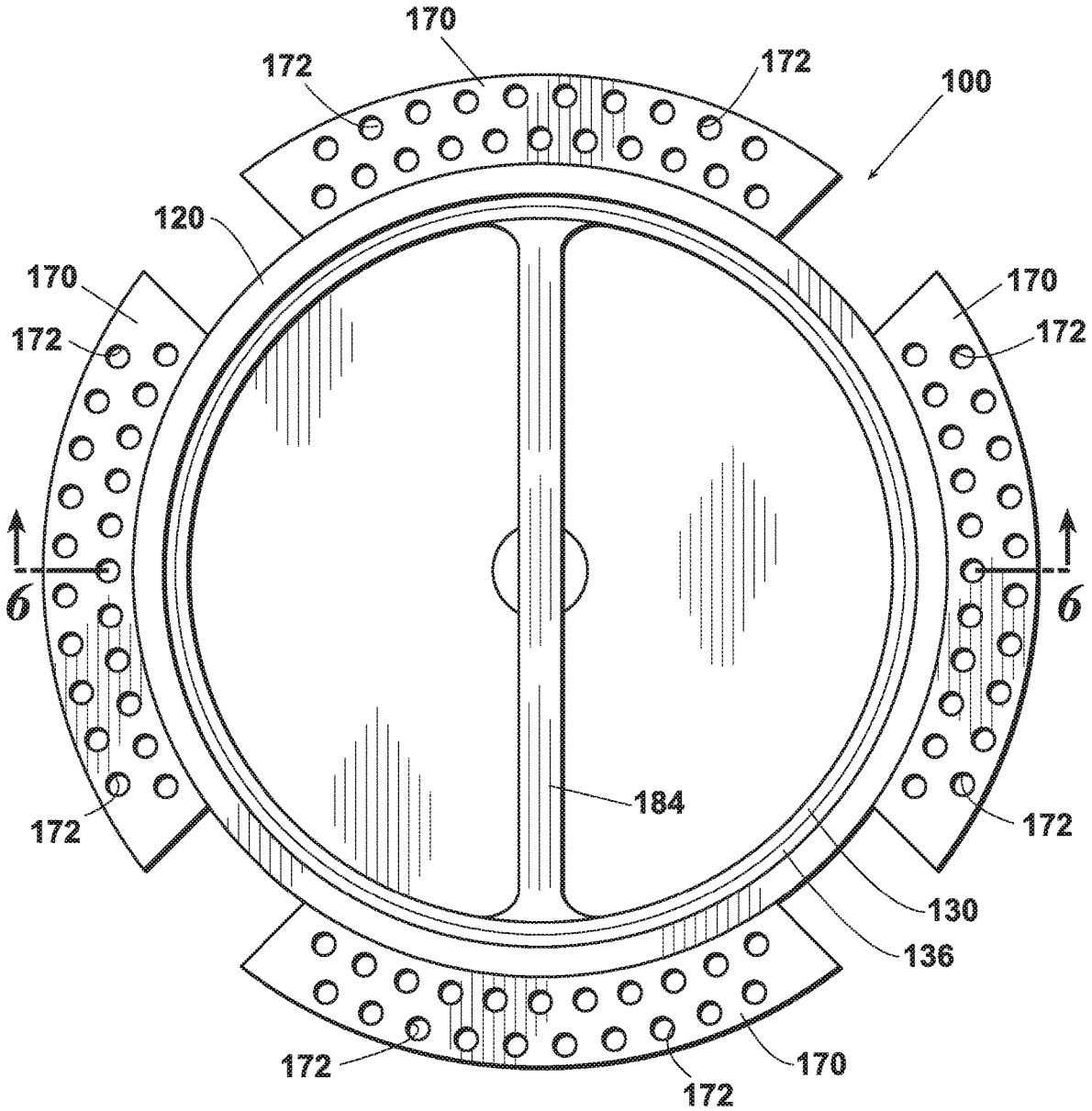
FIG. 5 is a top view of the flame arrester/burner assembly of the present invention with the burner vanes removed.
Figure 6A:
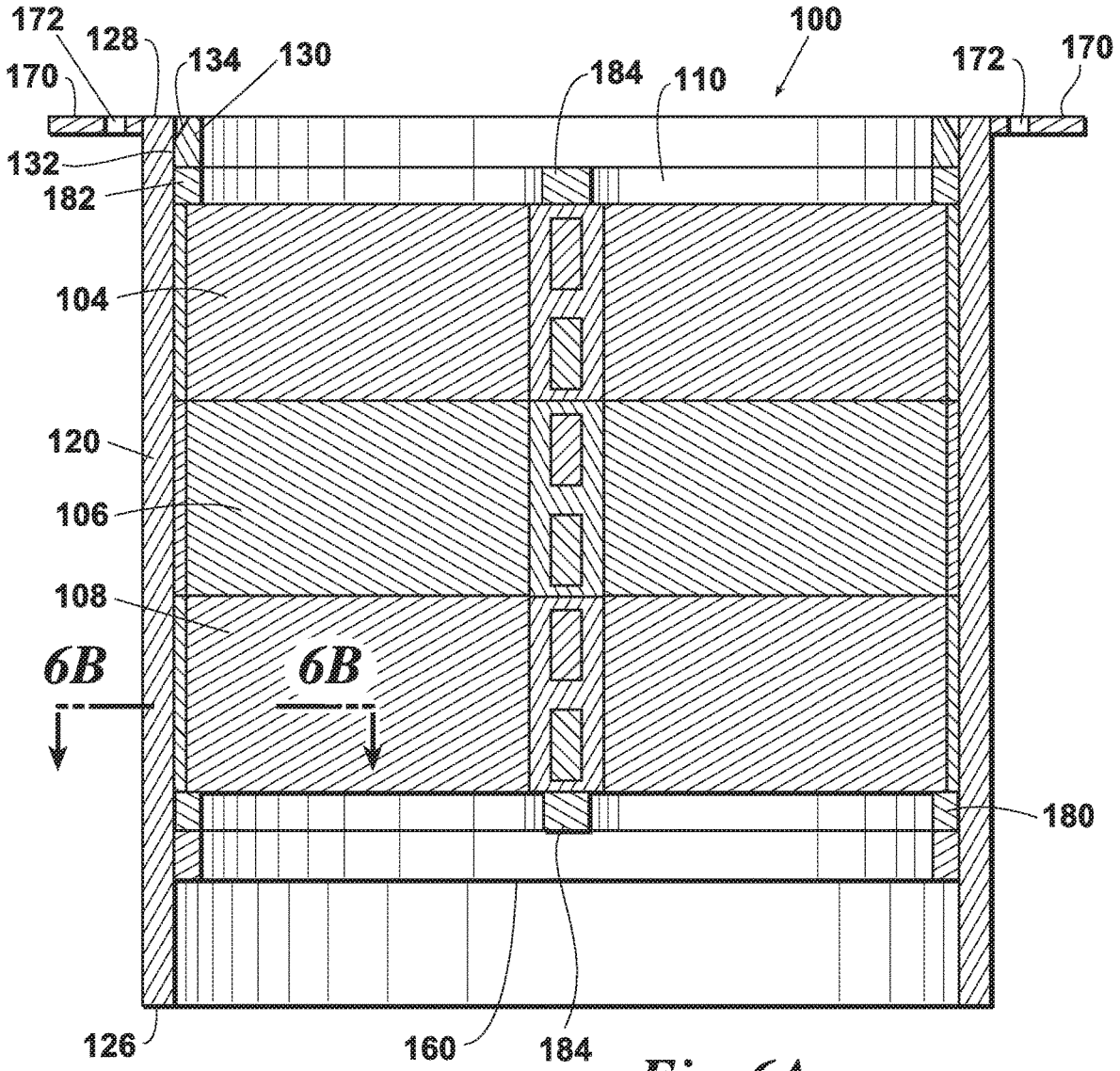
FIG. 6 is a cut-away side view taken along line 6-6 of FIG. 5.
Figure 6B:
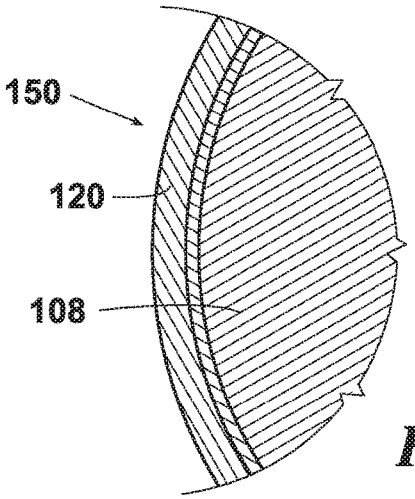

Next with reference to FIGS. 5 and FIG. 6, an alternate preferred embodiment of the burner/arrester assembly of the present disclosure shall next be described. This embodiment includes a flame arrester/burner assembly 100 including a multifarious element 102. In this embodiment, multifarious element 102 is comprised of three separate crimped ribbon segments 104, 106, and 108. Each separate crimped ribbon segment 104, 106, and 108 represents a separate and discrete arrester element. In this embodiment element 108 is on the bottom upon which element 106 is stacked. Element 104 is then stacked upon element 106. In this embodiment, however, there are no gaps or spaces between respective elements 104, 106, and 108.

In one embodiment, the assembly and the process for assembly of flame arrester/burner assembly 100 shall next be described. Pipe 120 is a length of stainless steel pipe suitable for flame arrester construction in a burner application. In an 8 inch embodiment, pipe 120 includes in inner diameter (ID) of 8 inches. Pipe 120 is preferably threaded along surface 124 adjacent end 126. For an 8 inch pipe example, such threads would be 8 NPT pipe threads.

Figure 11:
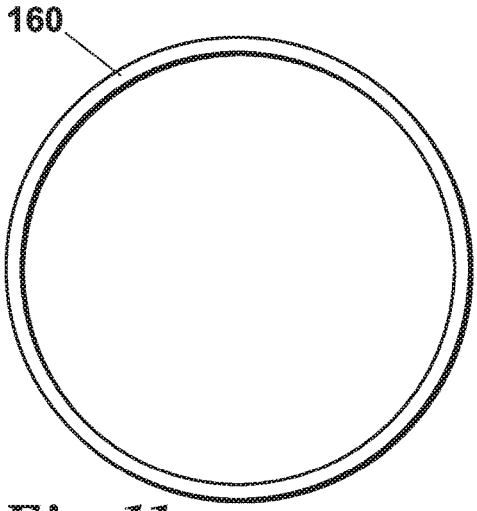
FIG. 11 is a top plan view of the bottom retaining ring of the arrester/burner assembly of the present disclosure.
Figure 12:
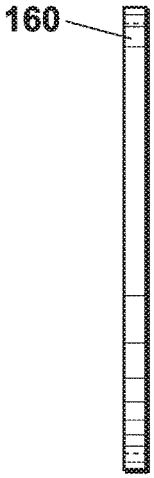
FIG. 12 is as side view of the bottom retaining ring of FIG. 11.

Bottom retaining spacer 160, shown particularly in FIGS. 11 and 12, is a section of cylindrical tubing cut and machined from a longer section of suitable stainless steel tubing. Bottom retaining spacer 160 is cut and machined so as to have an outer diameter (OD) which can be inserted into pipe 120 with substantially an interference fit. Once in place, bottom retaining spacer 160 is welded around its bottom circumference to pipe 120 facing the bottom/inlet end 126 of pipe 120.

Figure 7:
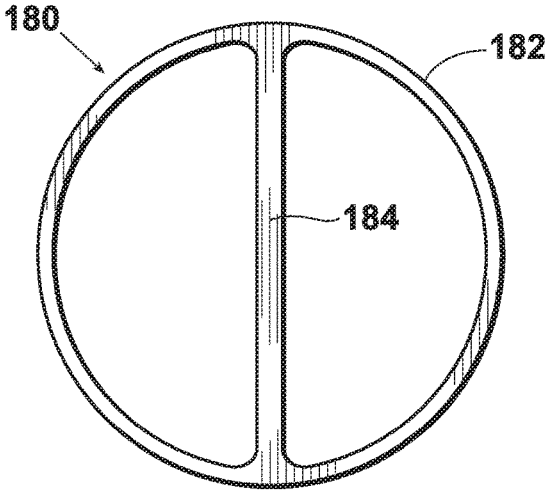
FIG. 7 is a top plan view of the burner media retainer of the arrester/burner assembly of the present disclosure.
Figure 8:
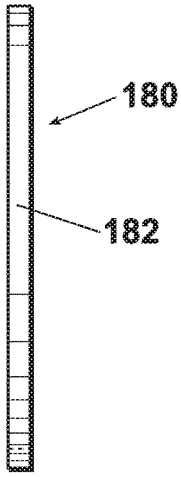
FIG. 8 is a side view of the burner media retainer of FIG. 7.

Single bar retaining rings, collectively 180, and shown particularly in FIGS. 7 and 8, are substantially identical. Each single bar retaining ring is comprised of a substantially annular ring 182 substantially bisected by a bar segment 184. Each single bar retaining ring 180 is machined out of a stainless steel plate and each of a diameter so as to be inserted into pipe 120 with an interference fit. The bottom single bar retaining ring is inserted into pipe 120 from the top 128 and positioned so as to abut bottom retaining spacer 160.

Arrester elements 104, 106, and 108 of multifarious element 102 are each manufactured separately and are preferably separate units. Each of elements 104, 106, and 108 are substantially identical and are formed by winding crimp ribbon around a center arbor 110 of preferably stainless pipe. The open ends of arbor 110 are plugged with stainless plugs and wrapped with stainless flat wraps. Crimp ribbon is then wound around arbor 110 in a consistent manner tightly but not too tightly so as to flatten out the crimps of the crimp ribbon. The cylindrical circumference of each element is tack welded so as to prevent sliding or telescoping. In this way consistent gas/fluid flow/pressure drop through the element is maintained. Once the desired diameter is obtained, stainless flat wrap is wrapped around the cylindrical circumference of the wound element. The wrap is wound tightly but again not too tightly so as to flatten out the crimps of the crimp ribbon.

For quality control purposes, a series of measurements of the hydraulic diameter of the windings of the crimp ribbon. A standard pin gauge available commercially is used for this measurement. Measurements are taken at predetermined points on each end of each finished cylindrical ends of elements 104, 106, and 108. In a preferred arrangement, 8 such measurements are taken at predetermined locations on each end of each element. Each measurement must be within the allowed tolerance of the gas group for which the flame arrester is to be employed for the element to pass inspection. If all measurements are within the standard tolerance for the gas group, the element passes QC inspection. Each measurement is recorded for each element and retained. Once the element is complete and passes QC inspection, it is assigned a serial number. Each measurement is recorded and tracked by the element serial number. This procedure is performed for each element wherein each element, such as 104, 106, and 108, is assigned a serial number for which each measurement is recorded, retained and tracked. Thus, for multifarious element 102, three serial numbers are assigned, one for each of the three crimp ribbon elements 104, 106, and 108 and 16 separate pin gauge measurements are recorded and tracked for each. The element serial numbers are marked on a, preferably, stainless steel label which will ultimately be permanently affixed to the outside of pipe 120. The element serial numbers are tracked along with the Purchase Order of the customer and provided to the customer as a part of a manual specific to the customer purchaser order and specific arrester 100 provided thereunder.

Once assembled and passed QC inspection, elements 104, 106, and 108 is respectively, successively inserted into pipe 120. The diameter of elements 104, 106, and 108 is predetermined so that each successive element slidingly fits within pipe 120. First element 108 is slidingly fit within pipe 120 such that it rests against lower single bar retaining ring 180 and welded to bar segment 182 of bottom single bar retaining ring 180 such that no space or gaps are present. Next, element 106 is slidingly fit into pipe 120 such that it rests against element 108 such that no gaps or space is present. Finally, element 104 is slidingly fit into pipe 120 such that it rests against element 106 such that no space or gap is present. Thus elements 108, 106, and 104 are each fit within pipe 120 with no gaps or space to form multifarious element 102.

In addition, the arrangement of elements 108, 106, and 104 should be selected such that the surfaces of their respective windings at the interfaces between elements do not align. With this non-alignment and lack of a space or gap, it has been determined that a test flame front stalls out at these non-aligning interfaces, see Table 1, below.

Installation of multifarious element 102 into pipe 120 is followed by a top single bar retaining ring 180. As stated above, top single bar retaining ring 180 is substantially identical to bottom single bar retaining ring 180. Top single bar retaining ring 180 is inserted into pipe 120 such that it rests against element 104 of multifarious element 102. Top single bar retaining ring 180 is positioned so that bar segment 184 shadows, or is symmetrical with, the position of bar segment 184 of bottom single bar retaining ring 180. This reduces restriction of gas flow, and thereby pressure drop across element 100. Once positioned, bar segment 184 is welded to the central arbor 110 of element 104.

Figure 9:
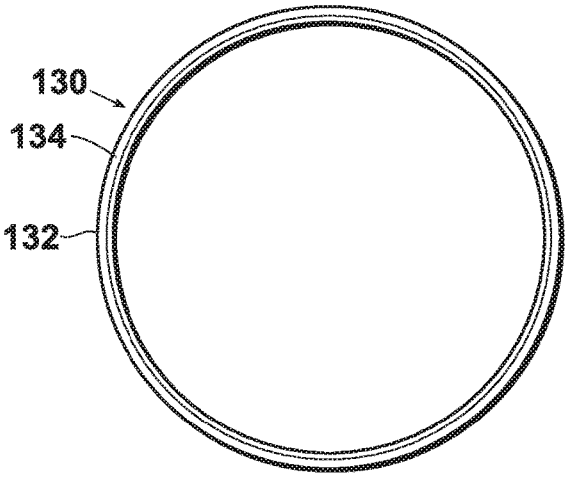
FIG. 9 is a top plan view of the beveled top retaining ring of the arrester/burner assembly of the present disclosure.
Figure 10:
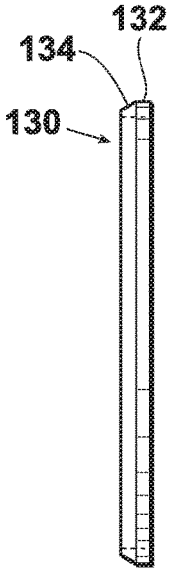
FIG. 10 is a side view of the beveled top retaining ring of FIG. 9.

Beveled top retaining spacer 130 is last to be inserted into pipe 120. With specific reference to FIGS. 9 and 10, beveled top retaining spacer 130 has an annular ring geometry, similar to bottom retaining spacer 160 except that it includes a cylindrical segment 132 and a beveled segment 134. Beveled top retaining spacer 130 is a section of cylindrical tubing cut and machined from a longer section of suitable stainless steel tubing so as to have cylindrical segment 132 and beveled segment 134. Beveled top retaining spacer 130 is cut and machined so as to have an outer diameter (OD) which can be inserted into pipe 120 with substantially an interference fit.

A bevel is machined into the inside of the top 128 of pipe 120 to mate beveled segment 134. Once beveled top retaining spacer 130 is inserted into pipe 120, arrester 100 is placed in a press such that beveled top retaining spacer 130 is subject to pressure of 10,000 psi evenly around its circumference. Beveled top retaining spacer 130 is then tack welded to the inside of pipe 120 in at least four places around it circumference. Arrester 100 is then removed from the press by releasing pressure slowly.

A full penetration weld using suitable stainless steel wire is placed around the circumference of beveled top retaining ring 130 in the space between beveled segment 134 and the beveled inside of top 128 of pipe 120. After welding, arrester 100 is placed on a lathe in order to machine the weld and both ends 126 and 128 of pipe 120. In this way, beveled top retaining ring 130 may be considered "hidden" and coupled with bottom retaining ring 160, securely retains multifarious element 102 within pipe 120. As such, there is no path provided for a flame to escape arrester 100 around beveled top retaining ring 130.

Air or wind vanes 170 are then welded to the exterior of pipe 120 using supports 174. Wind vanes 170 are known in the art and are commonly proprietary to a customer who specifies their geometry. As an example, wind vanes 170 of FIG. 5 include round holes 172, collectively which allow air to pass and cool arrester 100.

Completed arrester 100 is assigned a serial number which is also placed on the label permanently affixed to pipe 120. In addition, the serial number for arrester 100 is tracked along with the customer purchase order and retained.

Testing Protocol

A proposed testing protocol is taken in part from the test procedures outlined in Appendix A of Subpart 154, of the USCG and the CSA-Z343 standards (each incorporated fully herein by reference) but modified to be applicable to the FABA-XT of the present disclosure.

The proposed performance tests are modeled after the endurance burn and deflagration tests for Type I detonation arresters. Although functionally the FABA-XT is like an end-of-line flame arrester, Appendix A test procedures were selected over the 33 C.F.R. § 154.828(b) procedures, because of the severity of the burner's service and an abundance of conservatism. However, the detonation tests were not included, since the FABA-XT is an end-of-line device and there is no possibility of a detonation being generated without run-up piping.

Test Example 1 A flame arrester/burner of the design of the second preferred embodiment of FIGS. 5-11 was tested as follows.

| TEST INFORMATION | |
|---|---|
| DESCRIPTION OF TEST: Burn Test | |
| DESIGN TEMPERATURE: N/A | DESIGN PRESSURE: Atm |
| TEST METHOD: Modified 33 CFR Appendix A Continuous Burn Test | |
| TEST FLUID: Gasoline/Air @14.7% | |
| TEST REQUIREMENTS | |
| ACTUAL TEST PRESSURE: Atm | TEST FLUID TEMPERATURE: ambient |
| TEST DURATION: See Strip Chart Table 1<br>1 hour 12 Minutes | AMBIENT TEMPERATURE: 85° F. |
| TEST RESULTS: TABLE 1 | |
| START TIME: 13:41 | |
| FINISH TIME: 14:53 | |
| TEST EQUIPMENT | |
| TYPE: | RANGE: |
| Temp Strip Chart recorder | 0 to 2500° F. |
| CDI Air Mass flow meter | 0 to 100 CFM |
| Automizing nozzles for gas | 002 gpm @ 40 psi each |
| IR Video Camera | |

REMARKS:
Group C Crimp made by Paradox and pressed into housing between hidden retaining system with 5000 lbs. Uses 3 2inch elements with no gaps or screens.

Figure 13:
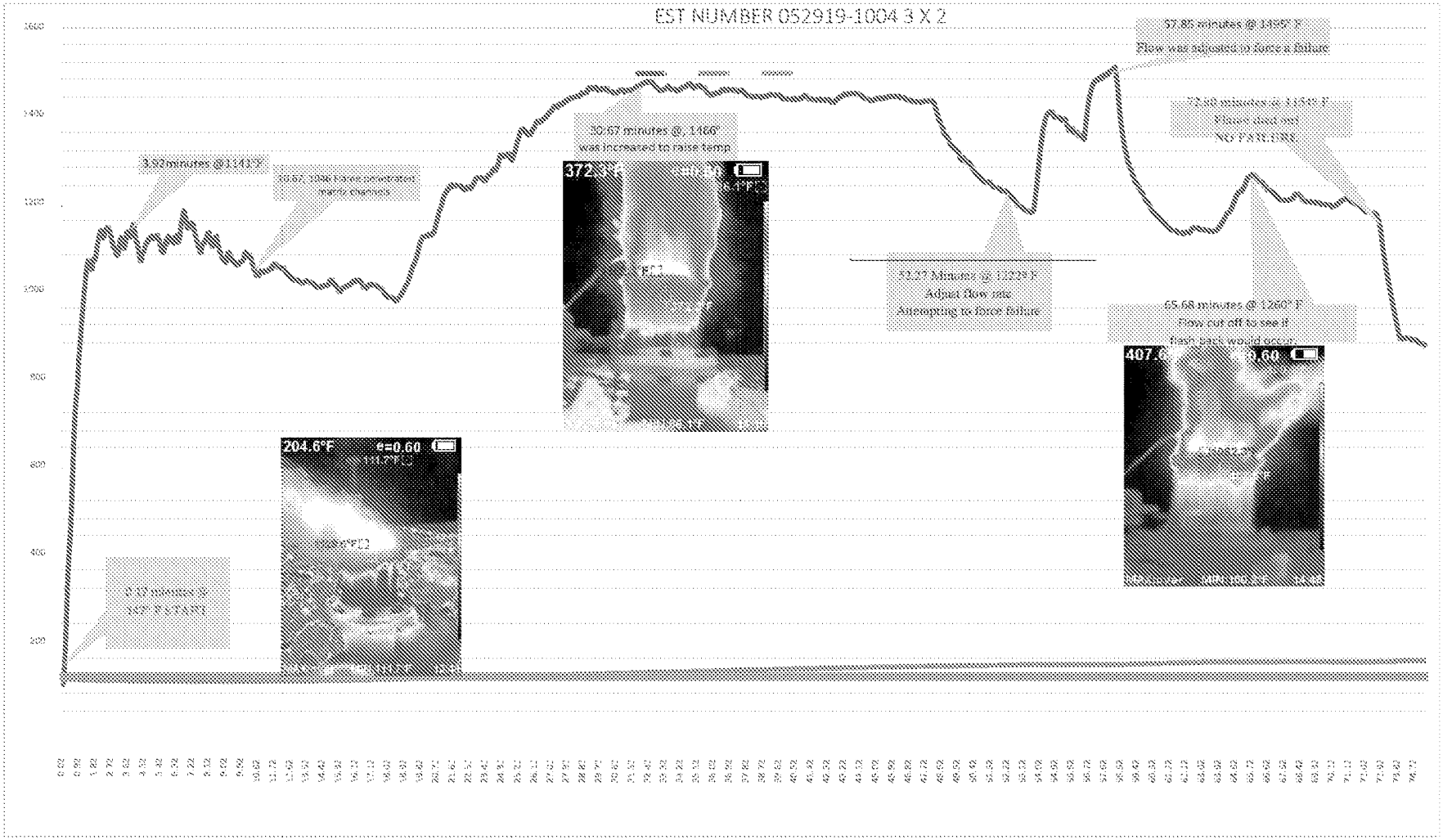
FIG. 13 graphically depicts the results of Test Example 1.

The results of Test Example 1 are depicted in FIG. 13.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A multifarious element flame arrester/burner, comprising:

a pipe body having a top end and bottom end;

a first retaining ring positioned adjacent said top end;

a second retaining ring positioned adjacent said bottom end;

a plurality of matrices positioned within said body between said first retaining ring and said second retaining ring wherein there are no gaps or screens between at least two of said plurality of matrices and wherein said at least two of said plurality of matrices are of disparate design, wherein said first retaining ring is beveled.

2. A method of constructing a multifarious element flame arrester/burner comprising the steps of:

obtaining a pipe body having a machined top end and bottom end; machining a first retaining ring;

machining a second retaining ring;

positioning a plurality of matrices within said body between said bottom end and said top end such there are no gaps or screens between at least two of said plurality of matrices and such that at least two of said plurality of matrices are of disparate design;

pressing said first retaining ring and said second retaining ring in said pipe body wherein said first retaining ring is positioned adjacent said top end and said second retaining ring is positioned adjacent said bottom end such that said first retaining ring and said second retaining ring retain said plurality of matrices within said body wherein said first retaining ring and said second retaining ring are pressed in said pipe body with at least 10,000 lbs of force.

* * * * *